US010249990B2

(12) United States Patent
Zhao et al.

(10) Patent No.: US 10,249,990 B2
(45) Date of Patent: Apr. 2, 2019

(54) ELECTRICAL CONNECTOR HAVING AN IMPROVED METAL SHELL

(71) Applicant: FOXCONN INTERCONNECT TECHNOLOGY LIMITED, Grand Cayman (KY)

(72) Inventors: Jun Zhao, HuaiAn (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/970,845

(22) Filed: May 3, 2018

(65) Prior Publication Data

US 2018/0323548 A1 Nov. 8, 2018

(30) Foreign Application Priority Data

May 4, 2017 (CN) ..... 201710306199

(51) Int. Cl.
*H01R 13/648* (2006.01)
*H01R 13/6581* (2011.01)
(Continued)

(52) U.S. Cl.
CPC ..... *H01R 13/6581* (2013.01); *H01R 13/50* (2013.01); *H01R 13/516* (2013.01);
(Continued)

(58) Field of Classification Search
CPC ..... H01R 13/6587; H01R 13/6594; H01R 13/7073; H01R 13/6873
(Continued)

(56) References Cited

U.S. PATENT DOCUMENTS 6,190,205 B1 * 2/2001 Wu ..... H01R 13/6582 439/607.34
7,097,504 B2 * 8/2006 Kan ..... H01R 23/6873 439/607.35
(Continued)

FOREIGN PATENT DOCUMENTS

TW M509995 10/2015
TW M510559 10/2015
(Continued)

*Primary Examiner* — Phuong Dinh
(74) *Attorney, Agent, or Firm* — Wei Te Chung; Ming Chieh Chang

(57) ABSTRACT

An electrical connector includes a terminal module including an insulative housing and a number of conductive terminals affixed to the insulative housing, and a shielding shell having a number of lateral walls and enclosing the insulative housing for forming a receiving room. The insulative housing has a base portion and a tongue portion extending forwardly from the base portion. The base portion has a mounting portion at a rear end thereof. Each conductive terminal has a contacting portion exposed to the tongue portion, a fixed portion affixed to the base portion and a soldering portion extending rearward from the mounting portion. The shielding shell includes a pair of supporting legs extending upwardly and resisting against the mounting portion. The supporting legs resisting against the mounting portion makes the base portion resist against gravity leading to a positive positioning of the tongue portion without upturning.

6 Claims, 11 Drawing Sheets

(51) Int. Cl.

| | |
|---|---|
| ***H01R 43/20*** | (2006.01) |
| ***H01R 13/50*** | (2006.01) |
| ***H01R 13/516*** | (2006.01) |
| *H01R 12/70* | (2011.01) |
| *H01R 13/52* | (2006.01) |

(52) U.S. Cl.
CPC ..... *H01R 43/20* (2013.01); *H01R 12/707* (2013.01); *H01R 12/7047* (2013.01); *H01R 13/5202* (2013.01)

(58) Field of Classification Search
USPC ..... 439/607.4, 607.35
See application file for complete search history.

(56) References Cited

U.S. PATENT DOCUMENTS

| | | | | |
|---|---|---|---|---|
| 7,901,221 | B1 * | 3/2011 | Li | H01R 13/6582 439/95 |
| 7,922,534 | B2 * | 4/2011 | Lin | H01R 13/64 439/544 |
| 8,882,542 | B2 * | 11/2014 | Song | H01R 12/707 439/607.4 |
| 9,768,560 | B2 | 9/2017 | Yao et al. | |
| 9,871,326 | B2 | 1/2018 | Zhao et al. | |
| 2012/0231661 | A1 * | 9/2012 | Song | H01R 12/707 439/607.4 |
| 2016/0352041 | A1 | 12/2016 | Yao et al. | |
| 2017/0352968 | A1 | 12/2017 | Zhang et al. | |

FOREIGN PATENT DOCUMENTS

| | | |
|---|---|---|
| TW | M518834 | 3/2016 |
| TW | I558003 | 11/2016 |
| TW | I573344 | 3/2017 |

* cited by examiner

ELECTRICAL CONNECTOR HAVING AN IMPROVED METAL SHELL

BACKGROUND OF THE DISCLOSURE

1. Field of the Disclosure

The present disclosure relates to an electrical connector, and more particularly to an electrical connector for ensuring positive position of a tongue portion thereof.

2. Description of Related Arts

U.S. Pat. No. 9,768,560 discloses an electrical connector including an insulative housing, a number of conductive contacts affixed to the insulative housing, a shielding plate affixed to the insulative housing, and a main shell enclosing the insulative housing for forming a receiving room. The insulative housing includes a base portion received in the receiving room and a tongue portion. The base portion defines a front surface and a rear surface. The base portion includes a number of locating grooves at an outer edge of the front surface. The main shell includes a number of front barriers extending forwardly to be exposed to the corresponding locating grooves. The front barriers prevent the insulative housing from moving forwardly overly. The tongue portion would be upturned when the base portion sinks due to gravity since the insulative housing does not have any supporting structures.

An improved electrical connector is desired.

SUMMARY OF THE DISCLOSURE

Accordingly, an object of the present disclosure is to provide an electrical connector ensuring a positive position of the tongue portion.

To achieve the above object, an electrical connector includes a terminal module including an insulative housing, a number of conductive terminals affixed to the insulative housing, and a shielding shell having a number of lateral walls and enclosing the insulative housing for forming a receiving room. The insulative housing has a base portion and a tongue portion extending forwardly from the base portion. The base portion has a mounting portion at a rear end thereof. Each conductive terminal has a contacting portion exposed to the tongue portion, a fixed portion affixed to the base portion, and a soldering portion extending rearward from the mounting portion. The shielding shell includes a pair of supporting legs extending upwardly and resisting against the mounting portion. The supporting legs resisting against the mounting portion makes the base portion resist against gravity, leading to a positive positioning of the tongue portion.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
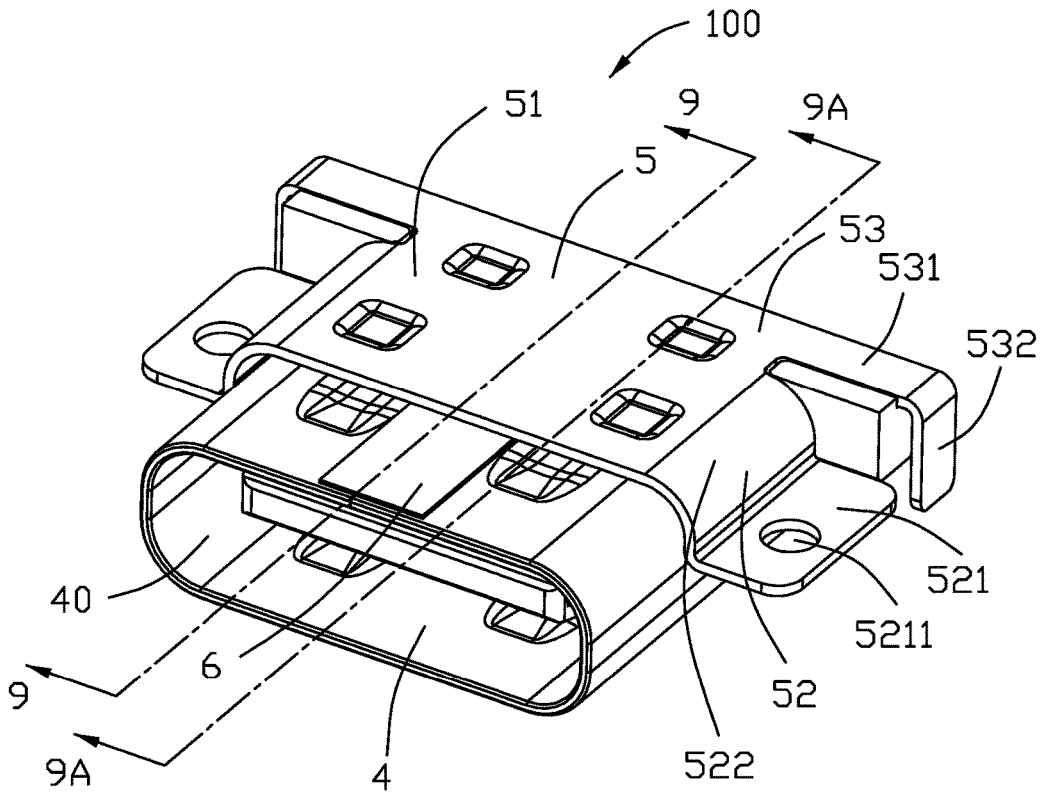
FIG. 1 is a perspective, assembled view of an electrical connector in a first embodiment.
Figure 2:
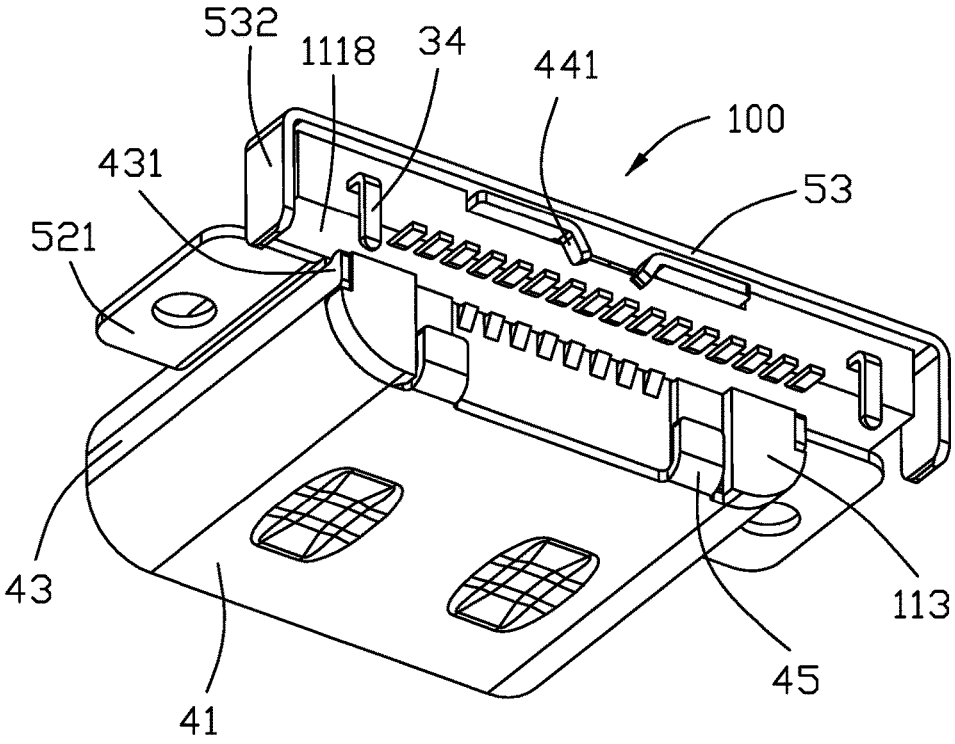
FIG. 2 is another assembled view of the electrical connector taken from FIG. 1 in the first embodiment.
Figure 3:
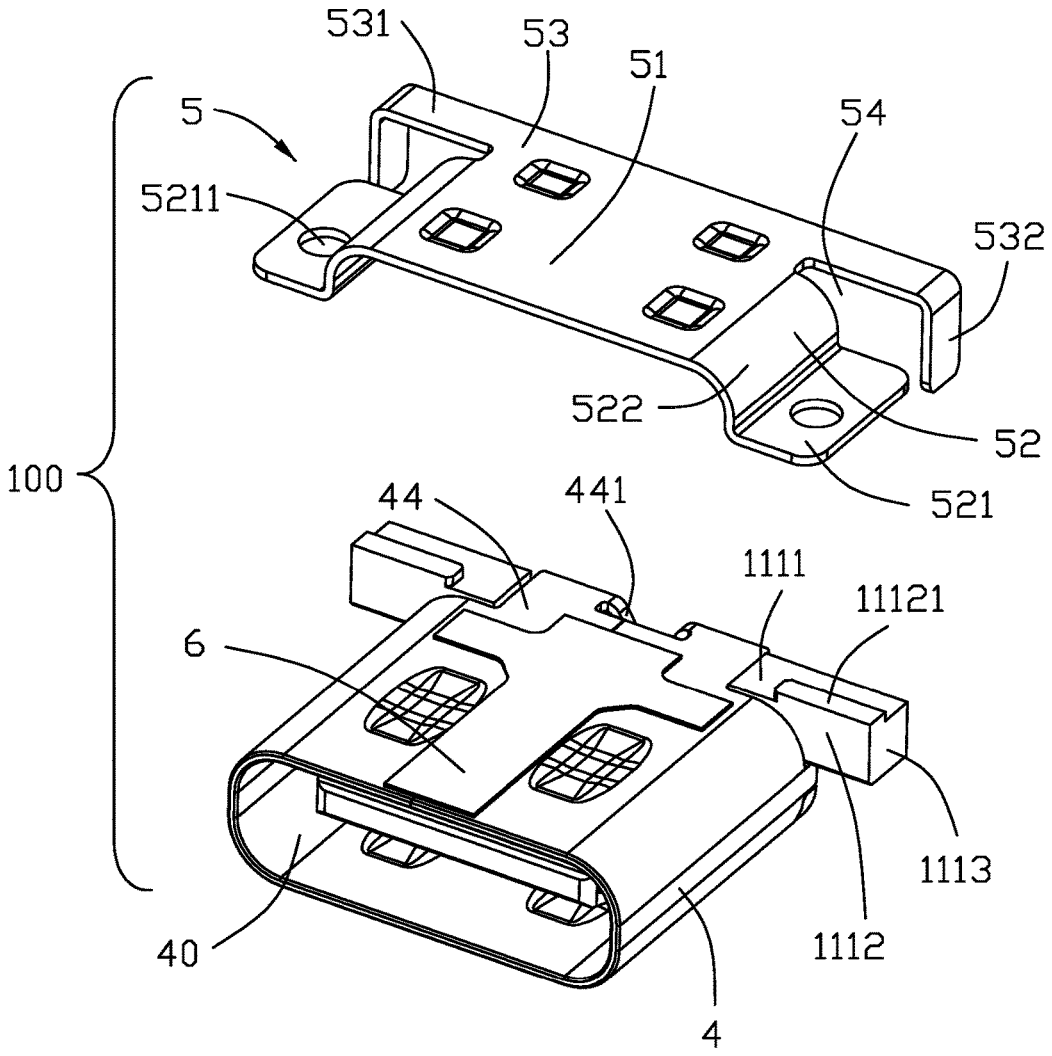
FIG. 3 is a partial exploded view of the electrical connector in the first embodiment.
Figure 4:
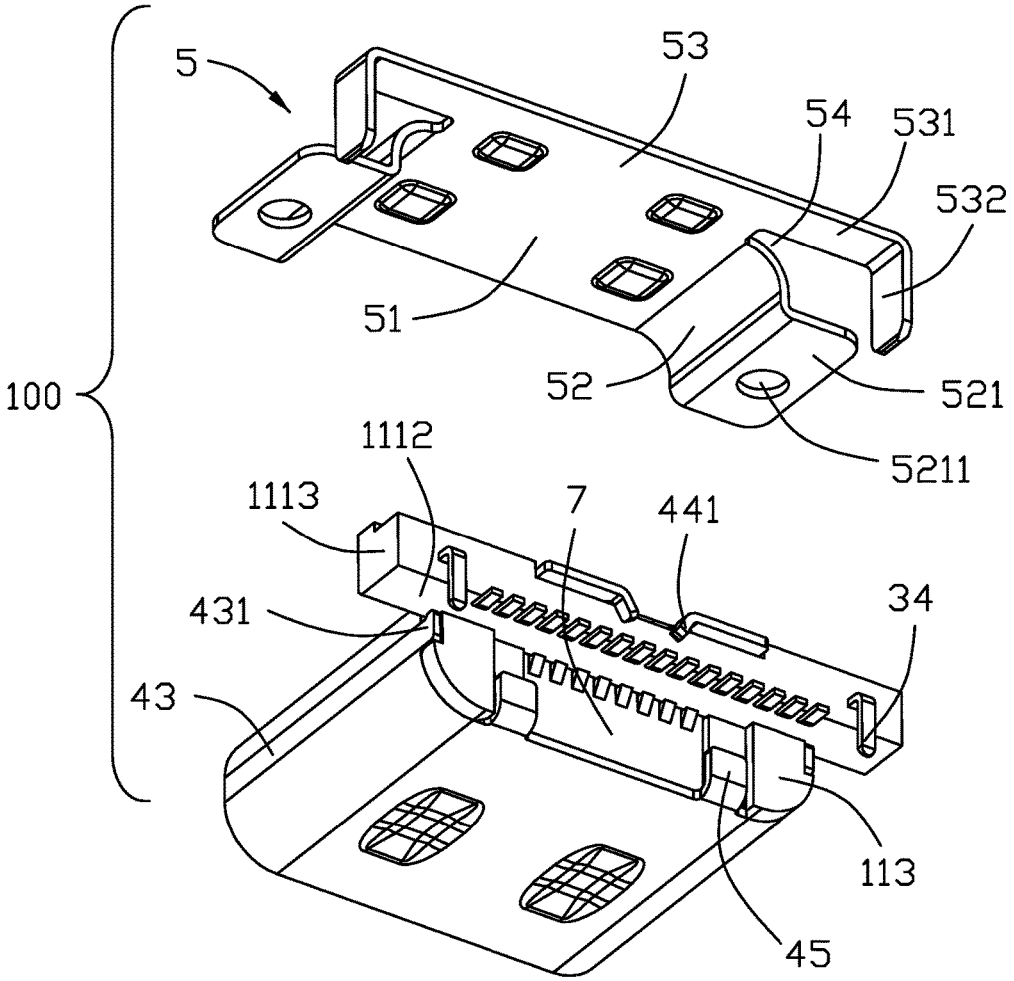
FIG. 4 is another partial exploded view of the electrical connector taken from FIG. 3 in the first embodiment.
Figure 5:
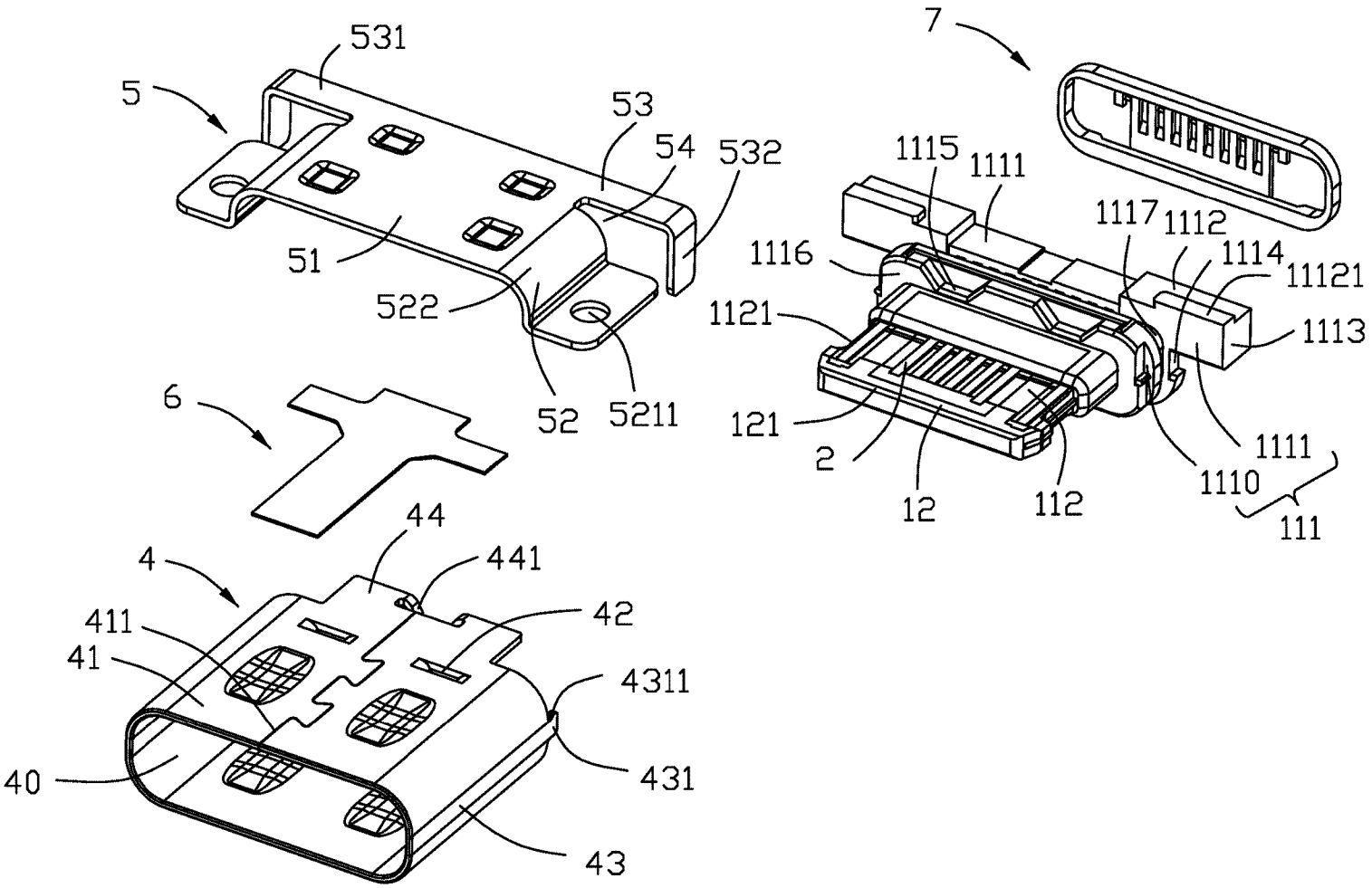
FIG. 5 is a further exploded view of the electrical connector taken from FIG. 3 in the first embodiment.

Reference will now be made in detail to the embodiments of the present disclosure. A first embodiment is shown in FIGS. 1 to 9(A). The electrical connector 100 includes a terminal module 10, a shielding shell enclosing the terminal module 10 for forming a receiving room 40 and a waterproof sealer 7 sealing a rear end of the electrical connector 100.

Referring to FIGS. 5 to 9(A), the terminal module 10 includes an insulative housing 1, a number of conductive terminals 2 affixed to the insulative housing 1 and a shielding plate 3 affixed to the insulative housing 1. Referring to FIGS. 2 to 6 and FIG. 9, the insulative housing 1 includes a first insulator 11 and a second insulator 12 integrated with the first insulator 11. The first insulator 11 includes a base portion 111 received in the receiving room 40 and a tongue portion 112 extending forwardly from the base portion 111 and forming a mating room with the receiving room 40. The base portion 111 includes a tail 1110 received in the receiving room 40 and a mounting portion 1111 extending rearward from the tail 1110 and extending outwardly from the shielding shell. The mounting portion 1111 protrudes from an upper surface of the tail 1110. The mounting portion 1111 includes a pair of protruding portions 1112 located at two sides thereof, a tuber 11121 protruding upwardly from the protruding portions 1112, a pair of lateral sides 1113 located at two sides of the protruding portions 1112 and a mounting surface 1118 located at a bottom surface thereof. The base portion 111 includes a pair of receiving grooves 1114 below the protruding portions 1112, a pair of resisting grooves 1115 recessed in a front end and communicating with a front surface of the tail 1110 and an annular groove 1117 located between the mounting portion 1111 and the tail 1110. The front surface of the tail 1110 is called as a first front surface 1116. The first insulator 11 further includes a pair of mating groove 1121 located at two sides of the tongue portion 112 and a pair of rear revisiting portions 113 below the protruding portions 1112 and protruding rearward from a rear surface of the tail 1110. The second insulator 12 includes a front covering portion 121 enclosing a front end of the first insulator 11.

Figure 6:
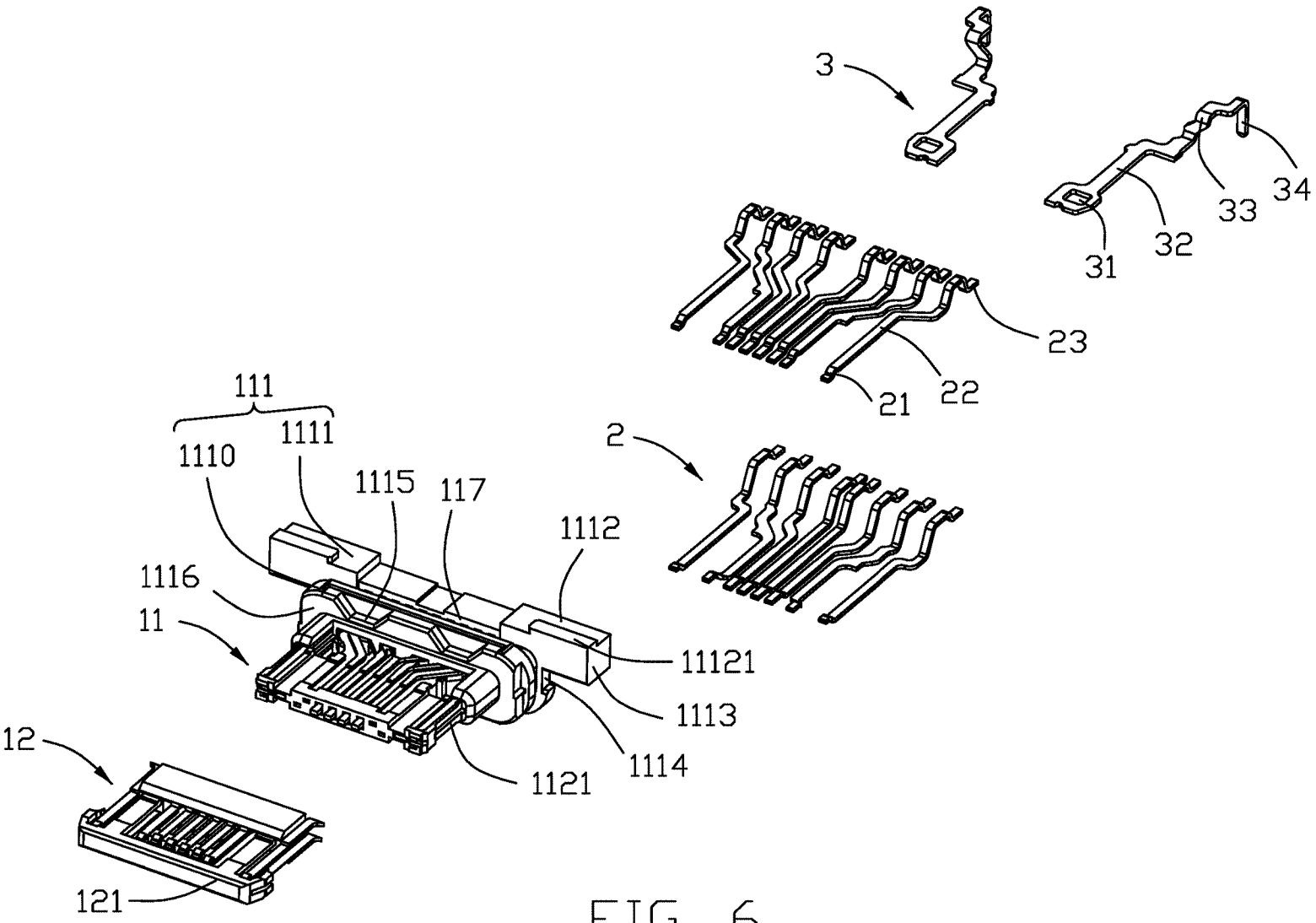
FIG. 6 is another further exploded view of the electrical connector taken from FIG. 5 in the first embodiment.
Figure 7:
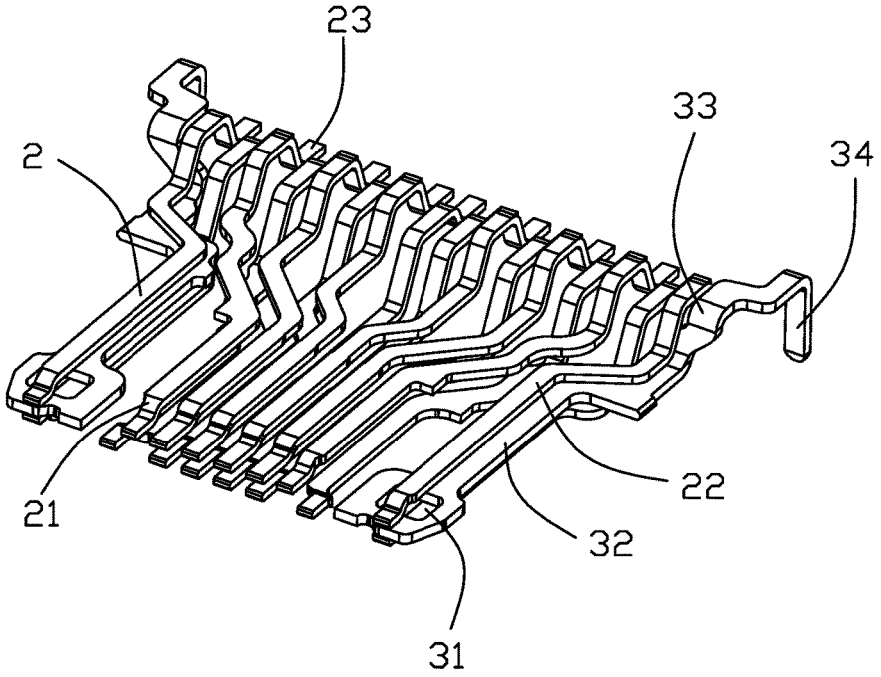
FIG. 7 is a partial assembled view of a number of conductive terminals and the shielding plate in the first embodiment.
Figure 8:
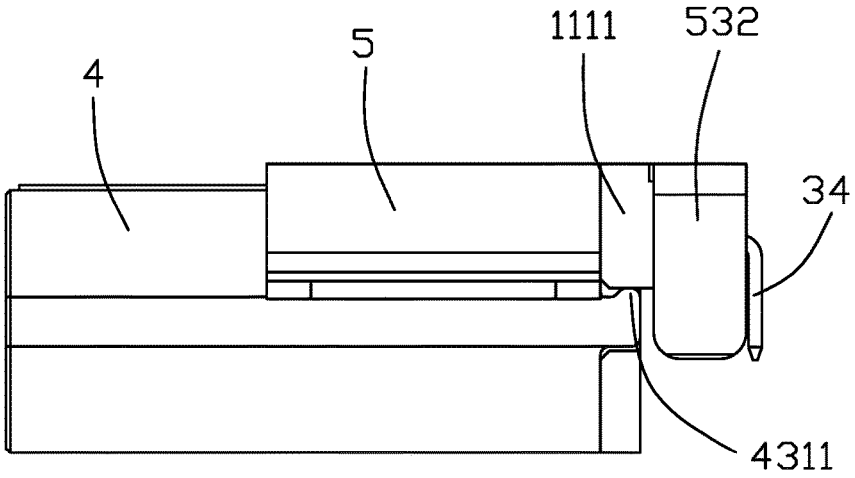
FIG. 8 is a side view of the electrical connector taken from FIG. 1 in the first embodiment.

Referring to FIGS. 6 to 7, each conductive terminal 2 includes a contacting portion 21 exposed to the tongue portion 112, a fixed portion 22 affixed to the tail 1110, and a soldering portion 23 extending rearward from the fixed portion 22 and extending outwardly of the mounting portion 1111. The fixed portion 22 connects the contacting portion 21 and the soldering portion 23. The soldering portions 23 of the conductive terminals 2 are in a same row.

Referring to FIGS. 5 to 9(A), the shielding plate 3 is affixed to the insulative housing. The shielding plate 3 includes a pair of locating holes 31, a main portion 32, a pair of soldering pins 34 extending outwardly from the mounting portion 1111, and a bending portion 33 connecting the main portion 32 and the soldering pins 34. The bending portion 33 bends upwardly. Two lateral sides of the shielding plate 3 is exposed to the mating groove 121 of the tongue portion 112.

Referring to FIGS. 1 to 5 and FIGS. 8 to 9(A), the metallic shielding shell includes a metal main/inner shell 4 shaped as a cylindrical shape and a metal sub-shell or outer shell 5 enclosing the metal shell 4. The metal shell 4 includes a top wall 41, a bottom wall opposite to the top wall 41, and a pair of lateral walls 43 connecting the top wall 41 and the bottom wall. The top wall 41 includes a riveted joint 411 shaped as a dovetail structure, a extending portion 44 extending rearward from the top wall 41, a pair of first barriers 441 bending downwardly from the extending portion 44 and resisting against a rear surface of the mounting portion 1111, and a pair of resisting protrusions 42 protruding to the receiving room 40. The metal shell 4 includes a pair of second barriers 45 extending upwardly from a rear end of the bottom wall and resisting against the tail 1110. The second barrier 45 is located inside the rear resisting portion 113 fixing the metal shell 4 and the terminal module 10. The first barrier 441 and the second barrier 45 prevent the terminal module 10 moving rearward. Each lateral wall 43 includes a supporting leg 431 resisting against the mounting surface 1118 of the mounting portion 1111. The supporting legs 431 and the lateral walls 43 are in a same plane. The supporting legs 431 are received in the receiving grooves 1114. Each supporting leg 431 includes a protrusion 4311 resisting against the mounting surface 1118 of the mounting portion 1111. The resisting protrusions 42 are received in the resisting grooves 1115. A front surface/edge 422 of the resisting protrusion 42 protrudes beyond the first front surface 1116 and there exists a space between a rear surface/edge 421 of the resisting protrusion 42 and a rear forward surface 11151 of the resisting grooves 1115 totally making the resisting protrusion 42 resisting against a corresponding connector and the force of the mating connector on the base portion 111 being weakened when the mating connector is inserted. The protruding portions 1112 protrude to the lateral walls 43 of the metal shell 4.

Referring to FIGS. 1 to 9(A), the sub-shell 5 includes an upper wall 51 attached to the top wall 41, a pair of lateral locating portions 52 extending laterally from the upper wall 51, a horizontal covering portion 53 covering the mounting portion 1111, and a pair of gaps 54 located between the horizontal covering portion 53 and the lateral locating portions 52. Each lateral locating portion 52 includes a lateral portion 522 attached to the lateral wall 43, and a horizontal portion 521 extending outwardly from a bottom end of the lateral portion 522. The horizontal portion 521 includes a fixing hole 5211 fixing the electrical connector 100 with a printed circuit board. A rear end of the lateral portion 522 resists against a front end of the protruding portion 1112. The horizontal covering portion 53 includes a pair of affixed portions 531 located laterally and a pair of assembling legs 532 extending downwardly and attached to the lateral sides 1113 of the protruding portions 1112. The assembling legs 532 are located laterally at the soldering portions 23. The gaps 54 are located at a rear edge of the affixed portions 531 and lateral portions 522.

Since the metal shell 4 forms the rivet joint 411 due to press forming, the electrical connector 100 is prone to leakage when working. The resisting protrusion 42 may tear and form an opening on the upper surface of the metal shell 4, or the resisting protrusion 42 may be directly recessed into the receiving room 40 without forming an opening.

Figure 10:
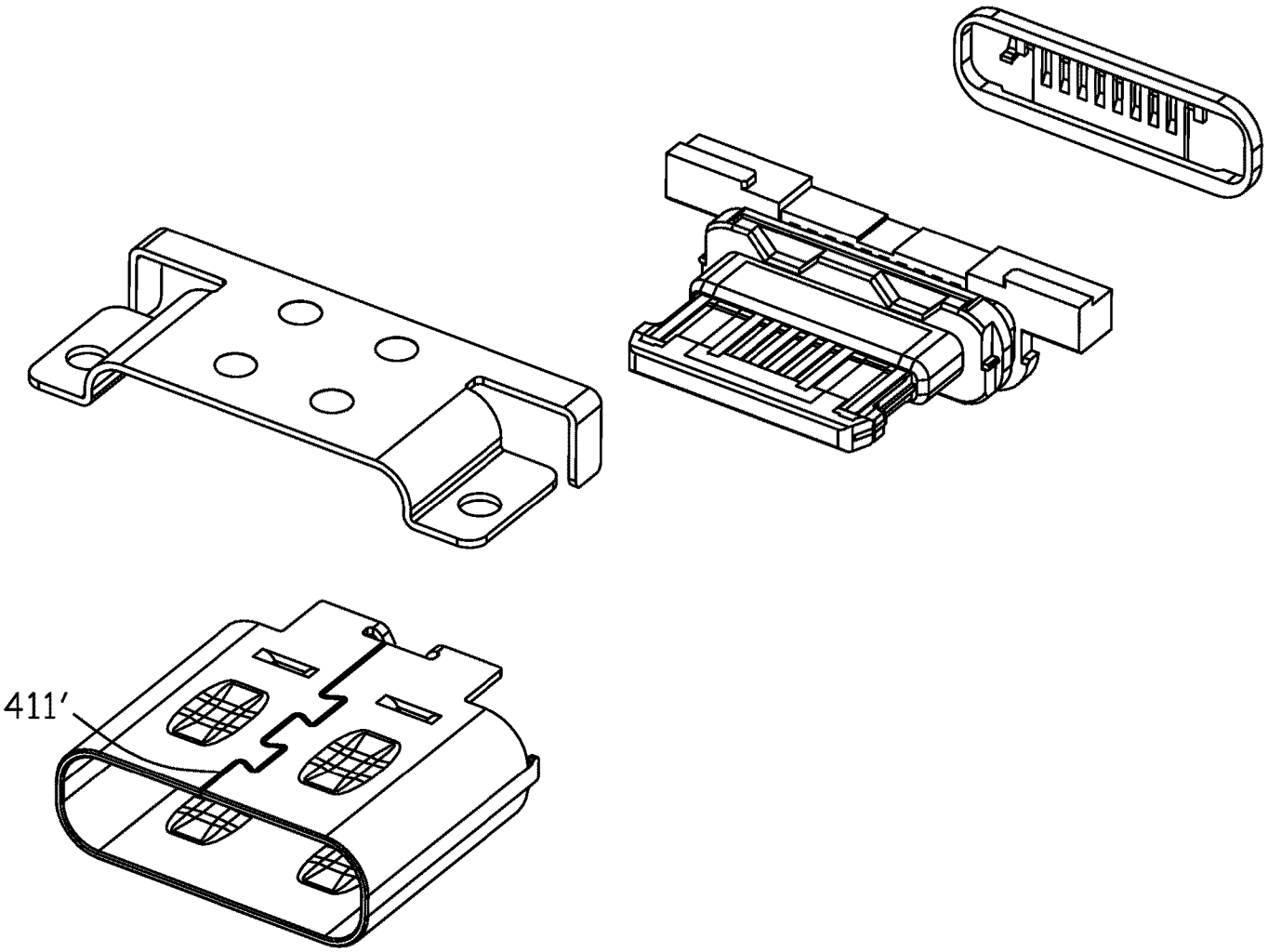
FIG. 10 is another exploded view of the electrical connector in a second embodiment.

The second embodiment is as shown in FIG. 10. The difference between the first embodiment and the second embodiment is the riveted joint. In the first embodiment, the electrical connector 100 includes a sticker 6 arranged in a "10" shape. The sticker 6 is applied to the riveted joint 411 and the resisting protrusion 42 to be waterproof. In the second embodiment, the riveted joint 411' are continuously and continuously welded together, thereby achieving waterproof of the electrical connector except the riveted joint.

The affixed portions 531 are stuck in the protruding portions 1112 and resist against a rear surface of the tuber 11121. The assembling legs 532 are kept outside of the lateral sides 1113 making the sub-shell 5 affixed to the terminal module 10. The mounting portion 1111 is stuck in the gap 54 further making the sub-shell 5 affixed to the terminal module 10.

A method of making the electrical connector 100 includes following steps. In a first step, provide the terminal module 10 including the insulative housing 1 and the conductive terminals 2 affixed to the insulative housing 1.

In a second step, provide the shielding shell including the receiving room 40 receiving the terminal module 10. The shielding shell includes a metal shell 4 and a sub-shell 5 attached to the metal shell 4. The metal shell 4 includes the supporting legs 431 extending rearward from the lateral walls 43.

In a third step, assemble the terminal module 10 to the receiving room 40 in a rear-to-front direction making the supporting legs 431 resisting against the mounting surface 1118 of the mounting portion 1111. Then, the metal shell 4 bends downwardly from the rear end of the top surface 41 to form the first barrier 441 resisting against the rear surface of the mounting portion 1111 and the second barrier 45 resisting against the rear surface of the tail 1110.

In a forth step, the assembled terminal module 10, metal shell 4 and sub-shell 5 are erected from the horizontal direction. At the rear end of the base portion 111 below the mounting portion 1111, glue is poured from the top to the bottom of the base portion 111 to fill the annular groove 1117 to form the waterproof sealer 7, so that the waterproof condition of the electrical connector 100 is achieved.

One feature of the invention is to have the terminal module 10 secured to the sub-shell 5 rather than to the metal shell 4. In other words, no portion of the metal shell 4 rearwardly abuts against the housing 1 of the terminal module 10 for assuring no force will be applied to the housing 1 directly from the metal shell 4 when an excessive force is imposed upon the metal shell 4 during mating. Instead, the housing 1 of the terminal module 10 is secured to the sub-shell 5 via the mounting portion 1111 of the base portion 111 being snugly received in the gap 54 and sandwiched between the rear edge of the lateral portion 522 and a front edge of the affixed portion 531 of the sub-shell 5 in the front-to-back direction as illustrated before. That is to say, any excessive force imposed upon the metal shell 4 can not be directly transferred to the housing 1 but indirectly via the sub-shell 4 because the metal shell 4 is soldered with the sub-shell 5, and the sub-shell 5 is secured to the housing 1. This indirect securement lowers the risks of the damage of the terminals 2 in the terminal module 10 due to excessive mating forces derived from the plug connector which is inserted into the receiving room 40.

Figure 9:
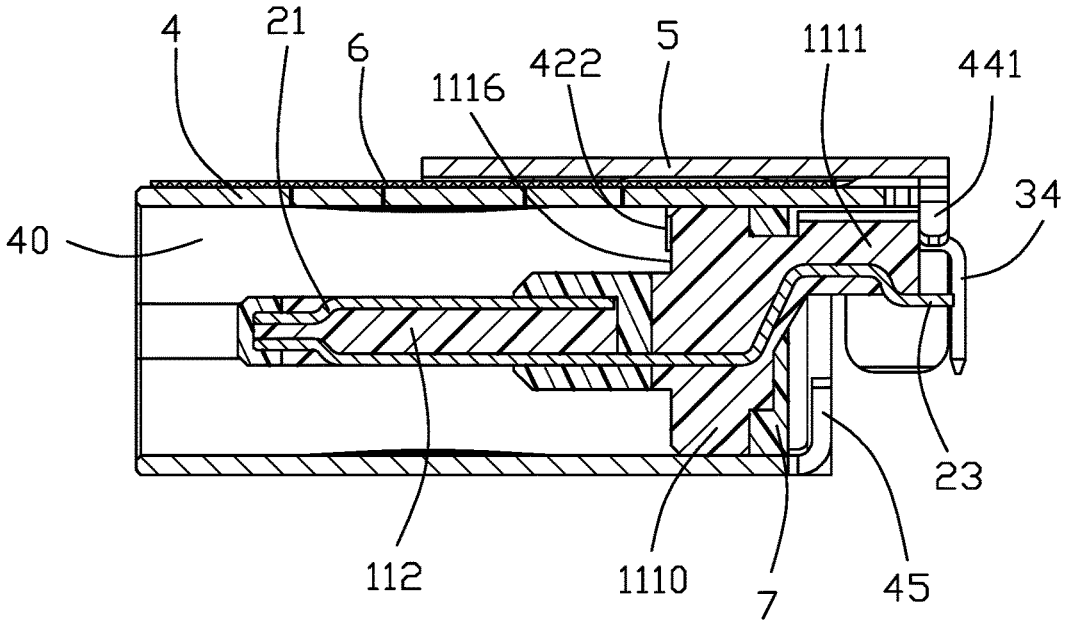
FIG. 9 is a cross-sectional view of the electrical connector taken along line 9-9 in FIG. 1 in the first embodiment.
Figure 9A:
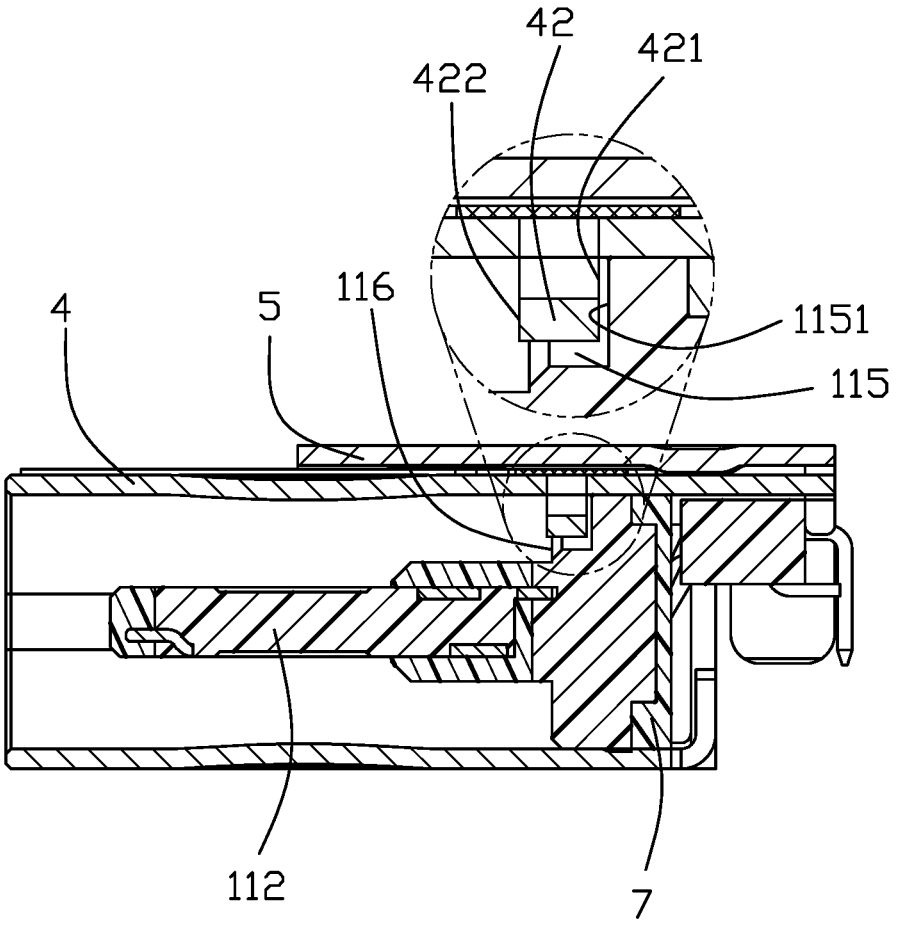
FIG. 9(A) is another cross-sectional view of the electrical connector taken along line 9(A)-9(A)

As shown in FIG. 9(A) and illustrated before, the resisting protrusion 42 loosely received within the corresponding resisting groove 1115 without contacting the housing 1 wherein a front edge of the resisting protrusion 42 is located outside of the resisting groove 1115 and beyond the first front surface 1116 in the front-to-back direction, and the rear edge 421 of the resisting protrusion 42 is spaced from the corresponding rear forward surface 11151 in a rear end of the resisting groove 1115 in the front-to-back direction. Similarly, the apex of the resisting protrusion 42 is also spaced from the housing 1 in the vertical direction in the resisting groove 1115. On the other hand, the main shell 4 snugly receives the housing 1 in both the vertical direction and the transverse direction. Under this arrangement, the metal shell 4 may precisely control the position of the housing in both the vertical direction and the horizontal/transverse direction for assuring proper mating forces between the inserted plug connector (not shown) and the electrical connector 100 while avoiding damage of the terminals 2 of the terminal module 10 due to excessive insertion forces derived from the inserted plug connector during mating, which is directly imposed upon the resisting protrusions 42 of the metal shell 4 and indirectly applied to the terminal module 10 via the sub-shell 5 which is fixed to the metal shell 4. It is also noted that in the invention the sub-shell 5 includes either the horizontal portion 521 or the assembling leg 532 for mounting to a printed circuit board (not shown) on which the soldering portions 23 of the terminals 2 are mounted, while the main shell 4 lacks those mounting structures used to mounting to the printed circuit board so as to obtain a complete circumferential structure of the mating cavity or receiving room for mating with the corresponding plug connector in a reliable shielding manner.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a terminal module comprising an insulative housing having a base portion and a tongue portion extending forwardly from the base portion and a plurality of conductive terminals affixed to the insulative housing, the base portion having a mounting portion at a rear end thereof, each conductive terminal having a contacting portion exposed to the tongue portion, a fixed portion affixed to the base portion, and a soldering portion extending rearward from the mounting portion; and a shielding shell having a plurality of lateral walls and enclosing the insulative housing for forming a receiving room; wherein the shielding shell comprises a pair of supporting legs extending upwardly and resisting against the mounting portion, wherein the shielding shell comprises a metal main shell shaped as a cylindrical shape and a sub-shell enclosing the metal shell, and the supporting legs extend rearward from the lateral walls and resist against a mounting surface of the mounting portion, wherein the supporting legs and the lateral walls are in a same plane, wherein the mounting portion comprises a pair of protruding portions extending laterally from the lateral walls, the sub-shell comprises an upper wall attached to a top wall of the metal shell and a pair of lateral portions attached to the lateral walls, and a rear end of each lateral portion resists against a front end of each protruding portion, wherein the sub-shell comprises a horizontal covering portion attached to the mounting portion and extending rearward from the upper wall and a pair of assembling legs covering the protruding portions and extending downwardly from the horizontal covering portion, wherein the top wall of the metal shell comprises a riveted joint welded together continuously, wherein the mounting portion is located at an upper surface of the base portion, and the metal shell comprises a first barrier resisting a rear surface of the mounting portion and a second barrier resisting a rear surface of the base portion and extending upwardly from a bottom surface of the metal shell, wherein the metal shell comprises a pair of resisting protrusions protruding into the receiving room, the base portion comprises a pair of resisting grooves corresponding to the resisting protrusions, and a front surface of the resisting protrusion protrudes beyond a front surface of the base portion.

2. The electrical connector as claimed in claim 1, wherein the soldering portions of the conductive terminals are arranged in a same row, and the assembling legs are located on both lateral sides of the soldering portions.

3. An electrical connector comprising:

a terminal module including an insulative housing and a plurality of terminals integrally formed with the housing, said housing including a base portion and a tongue portion extending forwardly from the base portion, said terminals including contacting portions exposed upon the tongue portion;

a metallic shielding shell attached upon the housing and including a metal main shell with a capsular configuration and a metal sub-shell fixed to the main shell and securing to the housing in a front-to-back direction without relative movement therebetween;

a receiving room formed in the main shell to receive the tongue portion;

a resisting protrusion formed on the main shell and extending into the receiving room; and a resisting groove formed in the base portion to receive the resisting protrusion; wherein the resisting protrusion forms a front edge extending beyond the base portion and outside of the resisting groove, and a rear edge spaced from a forward surface of the base portion in a rear end of the resisting groove so as not to directly transfer an excessive mating force along the front-to-back direction to the housing during mating, wherein said main shell forms at least one barrier to abut against a rear surface of the housing for preventing rearward movement of the housing relative to the main shell, wherein the main shell snugly receives the base portion in both a vertical direction and a transverse direction which are mutually perpendicular to each other and commonly perpendicular to said front-to-back direction so as to securely retain the housing to the main shell in both said vertical direction and said transverse direction, wherein the resisting protrusion is spaced from the base portion in a vertical direction perpendicular to said front-to-back direction.

4. The electrical connector as claimed in claim 3, wherein said sub-shell forms a gap to snugly receive a tuber of the base portion so as to restrict relative movement between the sub-shell and the housing in the front-to-back direction.

5. An electrical connector comprising:

a terminal module including an insulative housing and a plurality of terminals associatively disposed in the housing, said housing including a base portion and a tongue portion extending forwardly from the base portion, said terminals including contacting portions exposed upon the tongue portion;

a metallic shielding shell attached upon the housing and including a metal main shell with a capsular configuration and a metal sub-shell fixed to the main shell and holding the housing in a front-to-back direction;

a receiving room formed in the main shell to receive the tongue portion;

a resisting protrusion formed on the main shell and extending into the receiving room; and a resisting groove formed in the base portion to receive the resisting protrusion; wherein the resisting protrusion forms a front edge extending beyond the base portion and outside of the resisting groove, and a rear edge spaced from a forward surface of the base portion in a rear end of the resisting groove so as not to directly transfer an excessive mating force along the front-to-back direction to the housing during mating, wherein said main shell forms at least one barrier to abut against a rear surface of the housing for preventing rearward movement of the housing relative to the main shell, wherein the main shell snugly receives the base portion in both a vertical direction and a transverse direction which are mutually perpendicular to each other and commonly perpendicular to said front-to-back direction so as to securely retain the housing to the main shell in both said vertical direction and said transverse direction, wherein the resisting protrusion is spaced from the base portion in a vertical direction perpendicular to said front-to-back direction, wherein said sub-shell forms a gap to snugly receive a tuber of the base portion so as to restrict relative movement between the sub-shell and the housing in the front-to-back direction.

6. The electrical connector as claimed in claim 5, wherein the sub-shell forms means for mounting to a printed circuit board on which soldering portions of the terminals are mounted, which said main shell lacks said means.

* * * * *